United States Patent [19]

Bayliss

[11] 4,020,564

[45] May 3, 1977

[54] DRIER FOR TEMPERATURE SENSITIVE MATERIALS

[75] Inventor: Ronald W. Bayliss, Flemington, N.J.

[73] Assignee: NL Industries, Inc., New York, N.Y.

[22] Filed: Sept. 17, 1975

[21] Appl. No.: 614,190

[52] U.S. Cl. ..... 34/57 R; 432/58

[51] Int. Cl.[2] ..... F26B 17/00; F27B 15/00

[58] Field of Search ..... 34/10, 57 A, 57 R, 57 E; 432/14, 15, 58; 252/378 R

[56] References Cited

UNITED STATES PATENTS

| | | | |
|---|---|---|---|
| 2,154,000 | 4/1939 | Zizinia et al. | 34/10 X |
| 2,471,749 | 5/1949 | Howle | 252/378 R |
| 2,521,190 | 9/1950 | Stafford et al. | 432/58 |
| 3,262,213 | 7/1966 | Austin et al. | 34/10 |
| 3,348,599 | 10/1967 | Lohstoeter et al. | 34/57 R |
| 3,759,660 | 9/1973 | Bon et al. | 432/58 |

*Primary Examiner*—John J. Camby

[57] ABSTRACT

Solid materials of relatively low melting points are dried by fractionating a falling cylindrical curtain of solid material with high velocity gas streams emanating from a plurality of angularly oriented nozzles circumscribing the solid material curtain, the gas streams intersecting the solids curtain to create a downward, circular flow of solid particles intimately mixed with hot gas.

5 Claims, 4 Drawing Figures

DRIER FOR TEMPERATURE SENSITIVE MATERIALS

BACKGROUND OF INVENTION

Among organic and inorganic solid materials containing relatively large amounts of mechanical and/or chemically combined water are those that may be considered temperature sensitive in that they have relatively low melting temperatures. As a consequence drying these low melting materials presents many problems. Efforts to dry these materials using known types of dryers such as flash, fluid bed, rotary dryers and the like have not been satisfactory both because of their low throughputs and the poor thermal efficiencies, the latter resulting from the necessity of maintaining low inlet temperatures so as to preclude melting the material by contact with hot surfaces. Some measure of success has been achieved using a Lurgi-type drying tower wherein hot air is introduced into the bottom of a hundred foot tower and the solid material into the top whereby relatively long retention times are obtained thus affecting a high level of drying. However, this is done at the expense of low thermal efficiencies combined with the need for utilizing large volumes of hot air which is not only expensive but results in large volumes of noxtious gases being discharged into the atmosphere.

It is desirable therefore, to provide a drying technique capable of removing relatively large volumes of mechanically and/or chemically combined water from low melting solids at high thermal efficiencies while minimizing the volume of hot gases used; and to provide relatively inexpensive equipment for effecting these desired ends.

SUMMARY OF INVENTION

The present invention is the discovery, broadly, of a new drying technique for drying solid, low-melting-point materials efficiently using relatively inexpensive equipment and in a manner to preclude pollution of the atmosphere with large volumes of hot gases, the drying technique being characterized by feeding the material to be dried as a falling cylindrical curtain of solids and intersecting said curtain with high velocity, turbulent, rotating streams of relatively high temperature drying gas in such a way that the material can not contact surrounding hot surfaces during drying and, moreover, is broken up or fractionated by the turbulent gas streams so that relatively large areas of the material are exposed. As a consequence, heat transfer to the material is effected while the material is suspended in the hot gases thereby effecting high thermal efficiencies. Further, only relatively small volumes of hot gas are needed thus minimizing the amount of hot gas discharged into the atmosphere. Moreover, it has been found, that by using the co-current flow drying technique of this invention gas jet temperatures of from 300° F to as high as 750° F may be used in the drying operation while the temperature of the product being dried will remain as low as 110° to 120° F.

PREFERRED EMBODIMENT OF INVENTION

Figure 1:
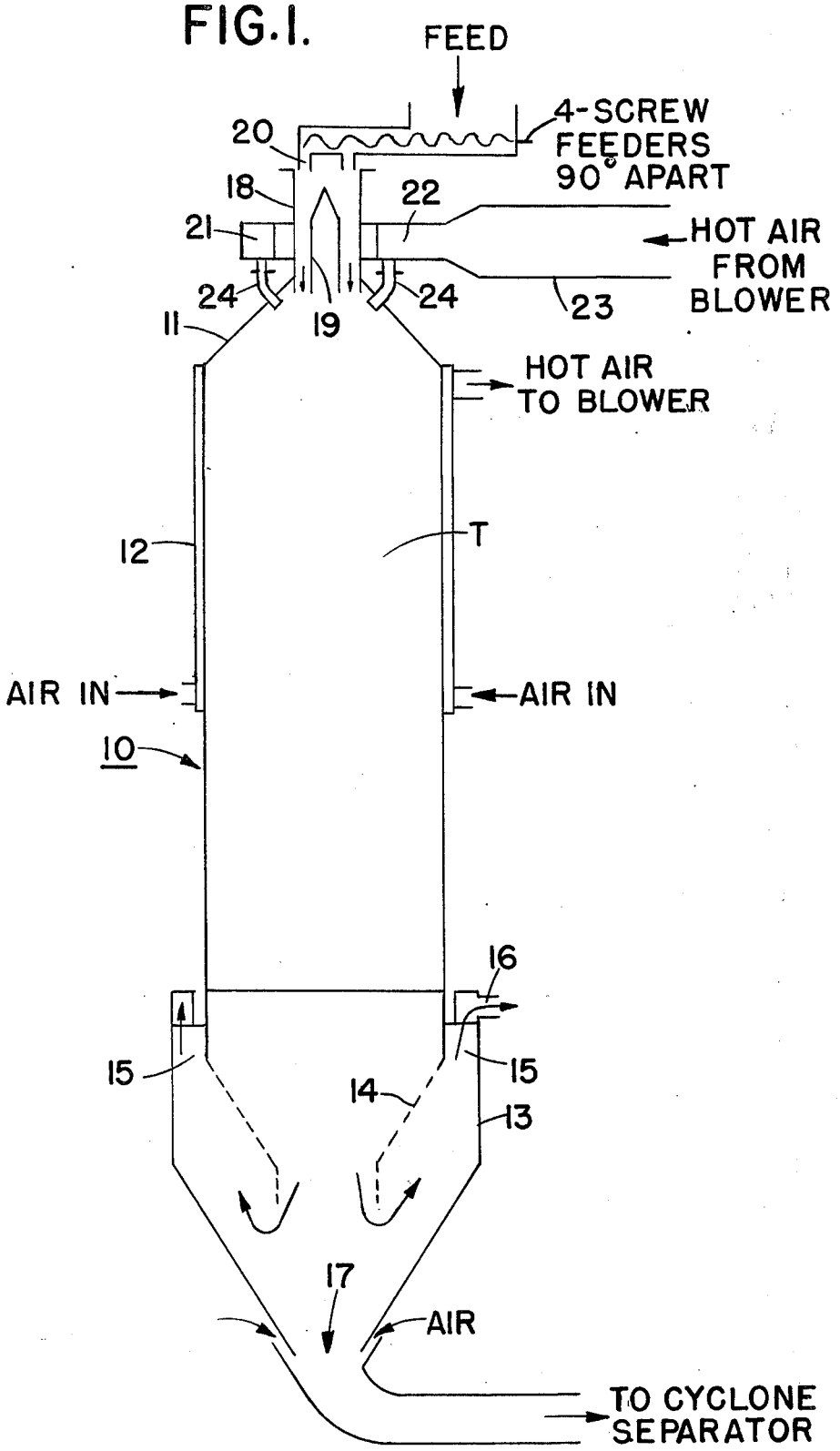
FIG. 1 is a schematic vertical elevation of the drying tower of this invention in which the hot gas jets extend into the upper end of the tower from the hot air manifold surrounding the top of the tower.

The drying technique of the instant invention comprises, essentially, feeding the solid material to be dried as a cylindrical curtain which is intersected by high velocity streams of hot gas from a plurality of angularly oriented nozzles circumscribing the solid material, the flow of the latter and the direction of flow of the streams of hot gas being co-current; and the action of the hot gas being such that the solid material is fragmented whereby maximum surface area is exposed to the hot gas, the fragmented material being dried while suspended within the column of hot gas thus precluding contact with any surrounding hot surfaces of the equipment. The dried material is then separated from the drying gas by conventional cyclonic separators or the like.

The gas may be air or other gases capable of removing water from the solid, temperature-sensitive material.

The temperature velocities of the hot streams of gas used in drying the material will depend in large measure on such factors as the desired throughput, the physical properties of the material to be dried, and the amount of water to be removed either as free or chemically combined water. By way of illustration only and not as a limitation on the scope of the invention it has been found that when drying i.e. removing the free water from a material such as hydrated ferrous sulfate ($FeSO_4 \cdot 7H_2O$), known as copperas, having a melting point of about 145° F, the inlet temperature of the hot gas, in this case air, may be in the range of from 300° to 750° F and preferably about 400° F —the outlet temperature of the gas from the drying chamber being about 125° to 250° F and preferably about 150° F. The inlet velocity of the hot gas may be in the range of from 5,000 to 15,000 feet per minute and preferably 12,000 feet per minute. Under these conditions the outlet temperature of the dried copperas is only about 110° F, and the volume of air discharged about 9,400 cubic feet per minute. Thus using the technique of this invention 1,740 lb/hr of free water can be removed in producing 19,140 lb/hr dry copperas (heptahydrate) from 20,800 lb/hr wet cake feed containing 50 percent $FeSO_4$.

By way of comparison when the same amount of product was dried using a conventional counter-current, rotary dryer having an inlet temperature of 145° F and an outlet temperature of 90° F the temperature of the dried copperas was 140° F, or within a few degrees of its melting point. Further, the volume of air discharged was 51,000 cubic feet per minute or more than five times the amount of air discharged using the novel technique of this invention.

Additional data in support of the novel drying techniques of this invention for removing free water from copperas is listed below.

Experimental data for drying Ferrous sulfate heptahydrate:

| | Run 1 | Run 2 | Run 3 |
|---|---|---|---|
| Dryer inlet gas temperature, ° F | 572 | 266 | 800 |
| Dryer outlet gas temperature, ° F | 200 | 145 | 300 |
| Solids feed inlet temperature, ° F | 50 | 50 | 50 |
| Product outlet temperature | 110 | <100 | — |
| Total moisture in feed, % | 50.0 | 50.0 | 50.0 |
| Total moisture in product | 46.2 | 45.9 | 42.4 |
| Product rate lb/hr. | 323 | 346 | — |
| Free $H_2O$ removed, % | 81.2 | 100 | 100 |

While the specific operating conditions given above were used in drying copperas it will be understood that the technique of this invention may be used for drying other materials having similar physical characteristics for example ammonium sulfate, hydrous calcium sulfate (gypsum), carbonates, metal chlorides, zinc and copper ores, carbohydrates and the like the operating conditions for which can be readily ascertained by experiment.

Referring to the drawings, FIG. 1 shows one embodiment of a dryer that may be used for carrying out the above described process. The drying tower is indicated at 10 and for purposes of illustration is a cylinder about 7 feet in diameter and 20 feet high provided with a conical cap 11. The upper 10 foot section of the cylindrical drying tower is shown with a jacket 12 through which air, at ambient temperature is passed so as to be preheated for use as a drying gas. Supported on the bottom of the cylindrical tower is solids-gas separating means comprising a hopper 13 approximately 9 feet in diameter comprising a 4-foot cylindrical side and a 60° cone. Mounted within the hopper is baffle means comprising a funnel shaped member 14 substantially concentric with the hopper but of smaller diameter such as to provide a substantially annular chamber 15 therebetween having a port 16 adapted to be connected to a blower (not shown) whereby the solids-laiden gases discharged from the drying tower are separated from the bulk of the hot gas which is exhausted from the hopper 13 by way of the port 16, the solids dropping down into an outlet 17 at the bottom of the hopper from which they are fed to a cyclone separator by means of cooling air inspired at the base of the apparatus in FIG. 1.

As regards, the conical cap 11 on the upper end of the dryer, this comprises a truncated cone from the upper end of which is intersected by material inlet means in the form of a feed tube 18 extending upwardly substantially vertically therefrom and coaxially therewith. Distributing means in the form of a conically capped tubular member 19 of smaller diameter than that of the inlet tube 18 is supported within the inlet tube 18 substantially concentrically therewith thereby forming a substantially ring-shaped passage in the inlet tube 18, as and for the purpose hereinafter described. The material to be dried is adapted to be fed into the upper end of the inlet tube 18 by positive feed means.

In this embodiment of the invention the positive feed means comprise four screw feeders arranged 90° apart, each with an annular discharge port 20 for positively feeding the material to be dried from a supply source into the inlet tube 18 of the dryer, the annular discharge ports 20 adapted to shape the material entering the upper end of the inlet tube 18 in the form of a ring which is converted by the distributing means 19 into a cylindrical curtain of solid material as it passes down through the inlet tube.

Surrounding the cylindrical inlet tube 18 is a ring-shaped, hot-gas manifold 21 substantially rectangular in cross-section and provided with a radial extension 22 connected to a source of hot gas indicated generally at 23.

Figure 3:
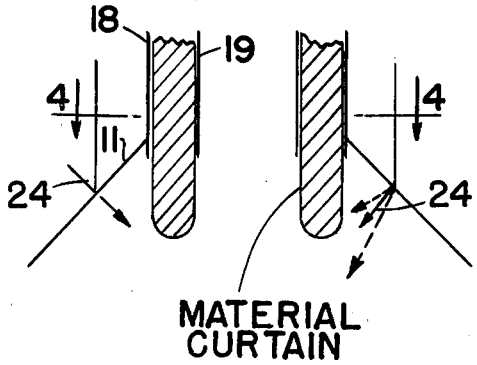
FIG. 3 is an enlarged, fragmentary, schematic, vertical elevation of the conical hood of the drying chamber of FIG. 1 showing the orientation of the spray nozzles.
Figure 4:
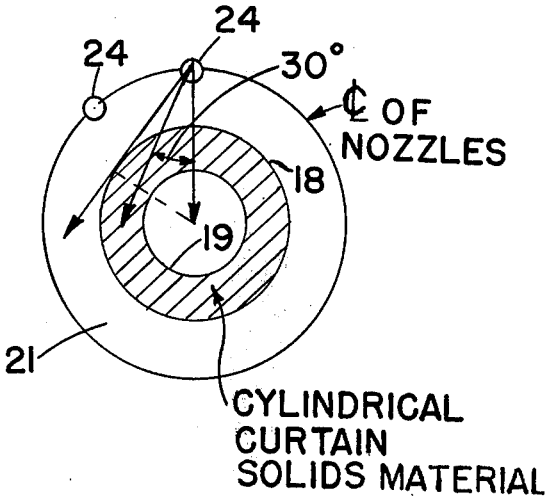
FIG. 4 is a schematic plan view on line 4—4 of FIG. 3 showing the orientation of the spray nozzles in said plan.

The ring manifold 21 is provided with a plurality of gas orifices, which in the present embodiment are in the form of jet nozzles 24 secured to the bottom of the manifold at equally spaced points therearound—12 jet nozzles being used in the present embodiment of the invention—for delivering a plurality of streams of hot gas at high velocity into said drying tower. To this end, jet nozzles 24 are bent so as to extend into corresponding apertures in the truncated cone 11 substantially perpendicular thereto and at a locus immediately below the bottom edge of the inlet tube 18, the jet nozzles being so oriented as to provide high velocity hot air streams impinging upon the exterior of the cylindrical curtain of feed material. Referring more particularly to FIG. 3 the centerlines of the nozzles are shown arranged at an obtuse angle of 135° to the vertical but as indicated by the dotted lines, may be at 120° to 150° depending on the gas flow rates, and pressure drop. In addition to their angular position to the vertical, which is designed downward to give a downward direction to the flow of gases co-current with the flow of the curtain of solid material, FIG. 4 shows that the axis of each nozzle is also at an angle to a radial line in a horizontal plane from the inlet tube 18 to the nozzle, the angle being from less than the angle of tangency of said line to the outer surface of said inlet tube to zero i.e. coincident with said radial line, a preferred angle being about 30°. By orientation of the jet nozzles as hereinabove described the gases substantially completely circumscribe the cylindrical curtain of solid material being fed from the inlet tube 18; and with a relatively high turbulence effect designed to fragment the material and also to prevent the latter from contacting any surrounding hot surfaces of the equipment, the hot gas streams simultaneously effecting intimate contact with particles of the material in a manner to effect optimum heat exchange.

Figure 2:
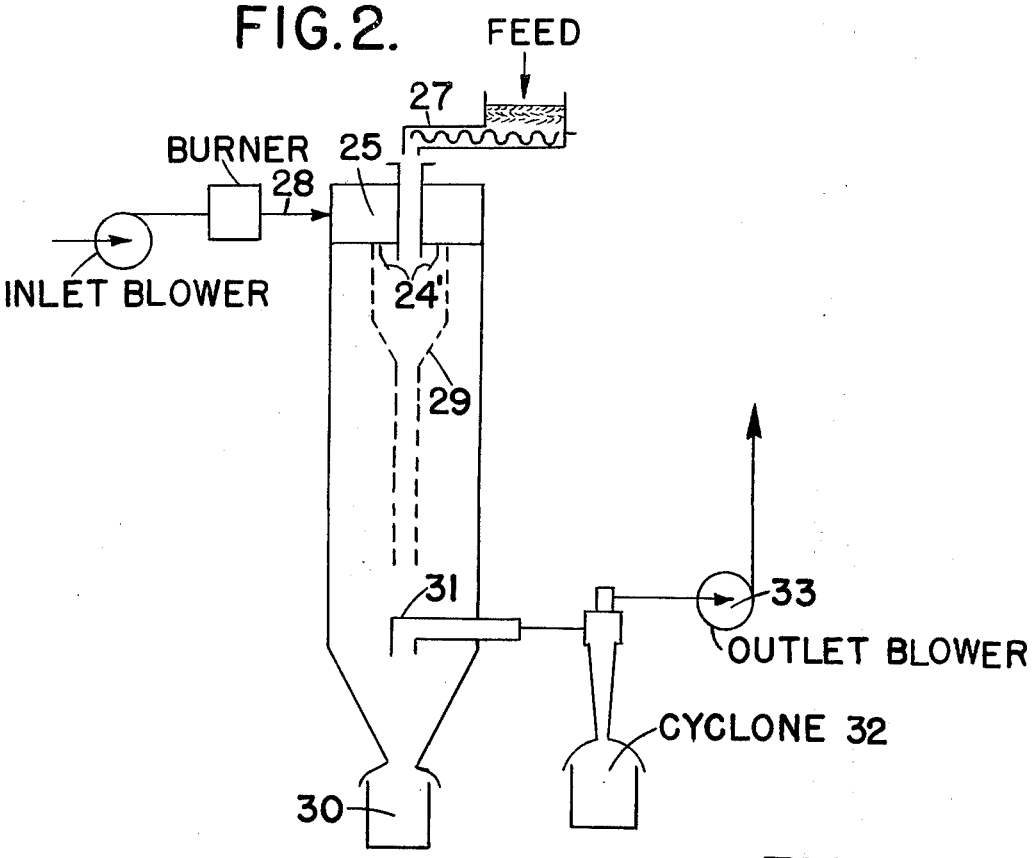
FIG. 2 is a modification of the drying tower of FIG. 1 wherein the hot gas jets enter the tower from a plenum chamber at the upper end thereof.

Referring to FIG. 2 in which like parts are similarly identified, in this embodiment of the invention the drying tower is provided at its upper end with a substantially drum-shaped plenum chamber 25. A simple cylindrical inlet tube 26 extends down through the center of the plenum chamber into the upper end of the drying chamber. Feed means in the form of a screw feeder 27 is arranged to feed the material to be dried into the upper end of the inlet tube 6. The hot gas for drying the material is blown into the plenum chamber as indicated at 28 these hot gases being adapted to issue from the plenum chamber through a plurality of nozzles 24' which are oriented within the upper end of the drying tower in the manner hereinabove described. Depending from the plenum chamber 25 is a funnel shaped conduit 29 supported by its upper enlarged end from the bottom of the plenum chamber 25 substantially coaxial with the drying tower, the upper enlarged end of the conduit 29 being of sufficient diameter to circumscribe the jet nozzles 24'. A solids collecting chamber 30 is located at the bottom of the drying chamber and a take-off pipe 31 is supported in the drying tower between the lower end of the funnel shaped conduit 29 and the outlet end of the drying chamber, the take-off pipe 31 being connected to a cyclone 32 which, in turn, is connected to a blower 33 whereby the hot gases in the dryer are drawn out of the dryer into the cyclone in which the suspended solid particles are separated from the gases and recovered in a suitable storage chamber. Operation of the apparatus of FIG. 2 for drying temperature sensitive materials is similar to that of the apparatus of FIG. 1.

While the apparatus shown in FIGS. 1–4 represent two types of equipment that have proven satisfactory in achieving the objects of the present invention it will be understood that modifications thereof are contemplated within the scope of the appended claims.

I claim:

1. Apparatus for drying temperature-sensitive solid materials said apparatus comprising: a substantially vertical drying tower having a cylindrical inlet at its upper end and an outlet at its lower end, feed means arranged to feed the solid material to be dried into said inlet and from thence into the upper end of said drying tower in the form of a substantially cylindrical curtain, gas feed means at the upper end of said tower arranged to form a plurality of high velocity, downwardly moving streams of hot gas impinging on said cylindrical curtain thereby to fragment and dry said material, said gas feed means comprising a gas manifold connected to a source of hot gas, and a plurality of nozzles in said manifold arranged to circumscribe the inlet of said drying tower and to cause impingement of the moving streams of hot gas from the exterior to the interior of the cylindrical curtain of downwardly moving material and means at the outlet of said tower arranged to separate the substantially dry material from the hot gases exiting from said tower.

2. Apparatus according to claim 1 wherein the longitudinal axis of nozzles slopes downwardly at an obtuse angle to the vertical and is oriented at an angle less than the angle of tangency of a line extending in a horizontal plain from said nozzle to the outer surface of the cylindrical inlet.

3. Apparatus according to claim wherein said obtuse angle is from 120° to 150° and the said angle less than the angle of tangency is zero degrees.

4. Apparatus according to claim 2 wherein said obtuse angle is 135° and said angle less than the angle of tangency is about 30°.

5. Apparatus for drying temperature-sensitive solid materials said apparatus comprising: a substantially vertical drying tower having a cylindrical inlet at its upper end and an outlet at its lower end, feed means arranged to feed the solid material to be dried into said inlet and from thence as a stream into the upper end of said drying tower, gas feed means at the upper end of said tower arranged to form a plurality of high velocity, downwardly moving streams of hot gas impinging on said stream of solid material thereby to fragment and dry said material, said gas feed means comprising a plenum chamber connected to a source of hot gas, the chamber being provided with a plurality of nozzles located at the bottom of said chamber, a generally funnel shaped conduit supported by its upper enlarged end from the bottom of the plenum chamber and being of sufficient diameter to circumscribe the nozzles, the nozzles being positioned exteriorly of the solid material stream and directed toward the outer surface of the stream, said outlet at the lower end being adapted for connection with solid and gaseous collection and transporting means.

* * * * *